US009601101B1

(12) United States Patent
Ullrich et al.

(10) Patent No.: US 9,601,101 B1
(45) Date of Patent: Mar. 21, 2017

(54) FREQUENCY CALIBRATION FOR AUDIO SYNTHESIZERS

(71) Applicants: Oliver Ullrich, Langenfeld (DE); Naphtali Rishe, Miami Beach, FL (US)

(72) Inventors: Oliver Ullrich, Langenfeld (DE); Naphtali Rishe, Miami Beach, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 14/847,627

(22) Filed: Sep. 8, 2015

(51) Int. Cl.
*G10H 1/00* (2006.01)
*G10H 5/00* (2006.01)
*G10H 7/00* (2006.01)

(52) U.S. Cl.
CPC ..... *G10H 7/00* (2013.01); *G10H 5/002* (2013.01)

(58) Field of Classification Search
CPC ..... G10H 7/00; G10H 5/002
USPC ..... 84/671, 683
See application file for complete search history.

(56) References Cited

U.S. PATENT DOCUMENTS 6,686,804 B1 * 2/2004 Adams ..... H03F 1/0277 331/16
7,546,097 B2 * 6/2009 Dunworth ..... H03L 7/0898 455/124
8,836,434 B2 * 9/2014 Bellaouar ..... H03C 3/0991 327/156

* cited by examiner

*Primary Examiner* — Jeffrey Donels
(74) *Attorney, Agent, or Firm* — Saliwanchik Lloyd & Eisenschenk

(57) ABSTRACT

Techniques and systems for facilitating the calibration of oscillation frequencies for an analog audio synthesizer are disclosed. Included are embodiments for performing the initial calibration of an audio synthesizer and for continuously compensating for the frequency irregularities which originate from insufficient calibration and/or frequency drift of the oscillator circuits. Embodiments can utilize the microcontroller already present in most synthesizers and require no further hardware.

18 Claims, 4 Drawing Sheets

FREQUENCY CALIBRATION FOR AUDIO SYNTHESIZERS

GOVERNMENT SUPPORT

This invention was made with government support under grant number IIS-1213026 awarded by the National Science Foundation. The government has certain rights in the invention.

BACKGROUND

Audio synthesizers with an analog sound generation chain, especially those with analog oscillators, are regarded as highly sought-after. In response to commands received, e.g., via the Musical Instrument Digital Interface (MIDI) protocol, a digital controller converts the received "play a note" instruction to a numerical value, which is then sent to one or more digital to analog converters (DACs). The analog control voltages yielded by those DACs are then routed to a number of analog voltage controlled oscillators (VCOs), which generate electrical waves of desired frequencies and of various wave forms. In many cases, these are then mixed, altered by one or more voltage controlled filters (VCFs), and amplified or attenuated to the desired volume by voltage controlled amplifiers (VCAs). The VCAs and the VCFs may be reactive to the user's inputs and adjustments, which coactively help to determine the character of the generated sounds.

VCO output frequencies usually respond to the applied control voltage levels either linearly or, more typically, exponentially (which translates to a frequency rise of one octave for each volt rise in the input voltage). Moreover, VCOs and their control voltage generating circuits have to be finely tuned so that the generated sound has exactly the correct frequency. This requires substantial calibration work for each manufactured oscillator, and thus constitutes significant effort for the manufacturer. Also, due to the nature of analog circuitry, frequencies can drift in the course of operating the audio synthesizer, dependent on components' tolerances and on conditions like the circuit's temperature, the ambient temperature, humidity, and other environmental factors.

As a result, elaborate and often costly circuitry is included in analog audio synthesizers to compensate for the problems of frequency calibration and operational drift. Even so, some manufacturers advise customers to let their synthesizers "warm-up" for 15-30 minutes after they are switched on, so that they might reach "operational temperature." However, enthusiasts know very well that, even after such a warm-up period, re-calibrating is typically necessary.

BRIEF SUMMARY

Techniques and systems for facilitating the calibration of oscillation frequencies for an analog audio synthesizer are disclosed. Techniques and systems of the subject invention describe an effective and efficient method of performing the initial calibration procedure and to continuously compensate for frequency irregularities which originate from insufficient calibration and/or frequency drift of the oscillator circuits.

Generally, techniques include: entering a calibration mode in which audio-producing components have a zero output volume level; retrieving a control value for a musical note to be calibrated; sending the control value to the wave-generating componentry; measuring the output wave frequency; retrieving a reference frequency for the musical note; comparing the measured frequency to the reference frequency with respect to a tolerance value; making an incremental or decremental adjustment to the control value when necessary; and repeating the process for the musical note until calibration of the control value within an acceptable tolerance value.

Techniques and systems can be employed without elaborate calibration circuitry. Embodiments of the subject invention may be embedded on a microcontroller device as part of an analog audio synthesizer. In fact, as microcontrollers are already present in many modern-day analog synthesizers, certain techniques of the subject invention may be implemented as an update to the firmware of an existing microcontroller on the synthesizer. Indeed, some implementations may be performed at low (or no) cost and also may make unnecessary the costly drift compensation circuitry used in traditional synthesizers.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Figure 1:
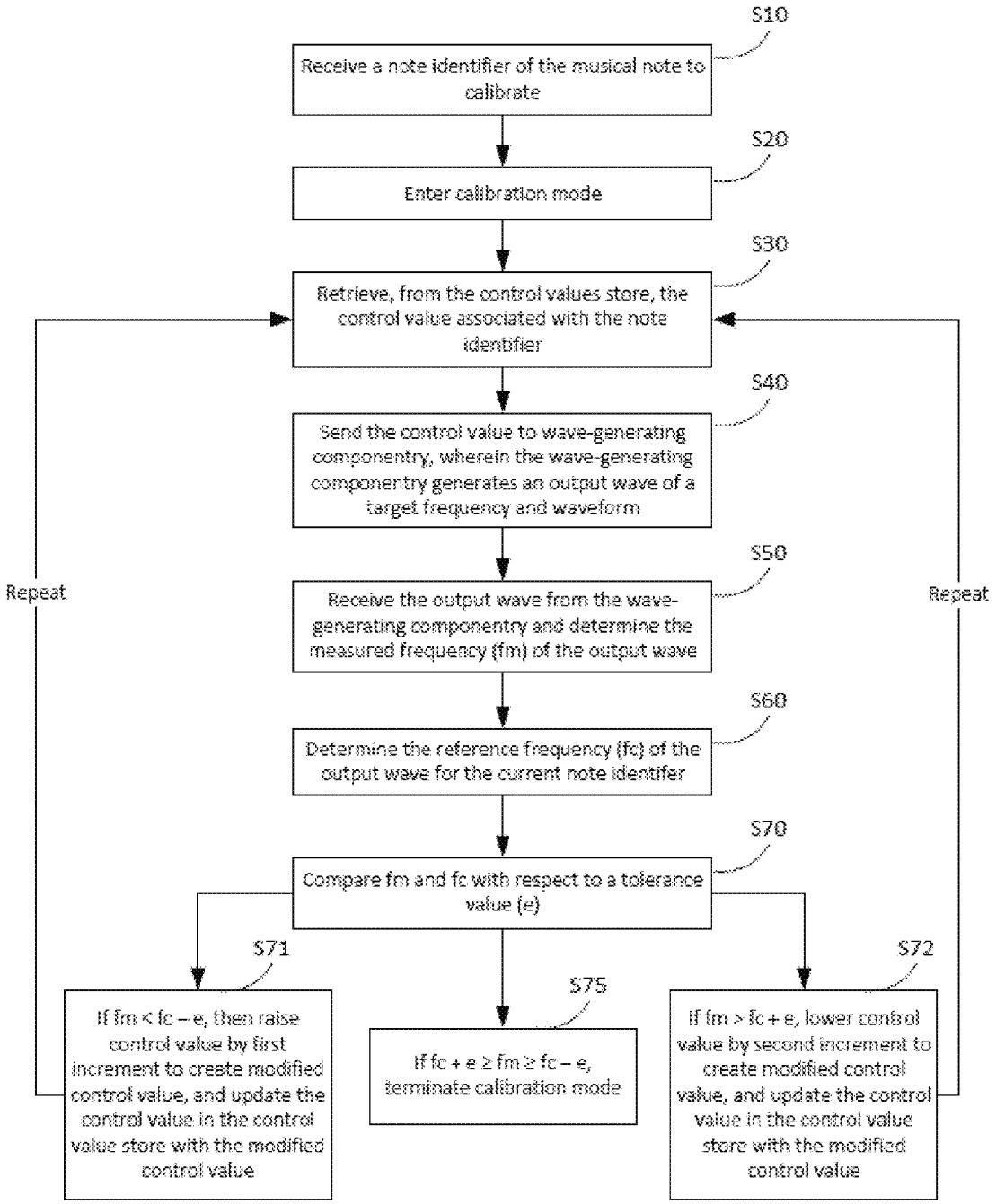
FIG. 1 shows an example process flow for calibrating the oscillation frequency for producing a musical note in an analog audio synthesizer.
Figure 2:
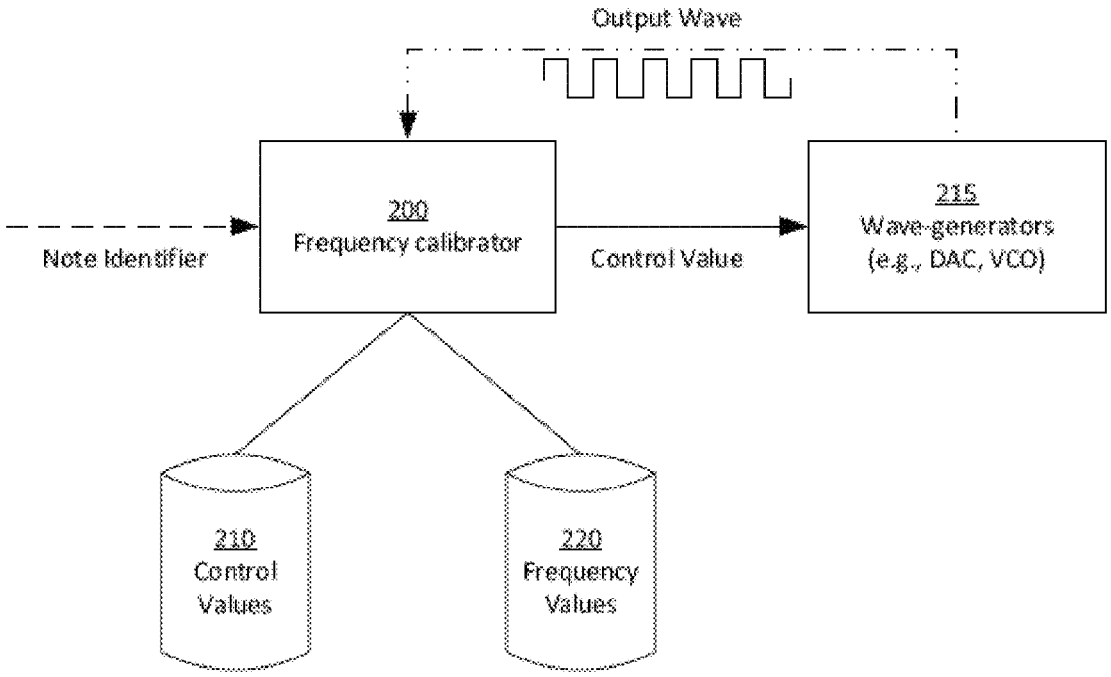
FIG. 2 shows an example component environment in which a system in accordance with the subject invention may be implemented.

FIG. 1 shows an example process flow for calibrating the oscillation frequency for producing a musical note in an analog audio synthesizer. FIG. 2 shows an example component environment in which a system in accordance with the subject invention may be implemented. In discussing the process flow in FIG. 1, reference may be made to components in FIG. 2, such as when discussing sending and receiving activities of the process flow. For example, at least some aspects of the process described in FIG. 1 can be performed by a frequency calibrator 200 as described with respect to FIG. 2.

Initially, a note identifier of the musical note to calibrate is received (S10), for example by a frequency calibrator 200 (FIG. 2). A note identifier is a representation of a musical note that identifies the note uniquely; the note identifier may be, for example, a straightforward textual/string representation of a note (e.g., "B#"), a numerical key value, or a machine instruction or function call, such as produced by a component following the MIDI protocol.

Depending on embodiment, the note identifier to calibrate can be sent from other hardware, software, or firmware components of the analog audio synthesizer.

When a note identifier is received, "calibration mode" is entered (S20). Calibration mode identifies a mode of operation of the analog audio synthesizer in which sound waves are being calibrated to the proper frequency rather than being played audibly. In certain implementations, instructions are sent to one or more components of the system or the analog audio synthesizer (e.g., the VCA) to set the sound volume to zero during the calibration. In some instances, sound waves may be redirected or intercepted from audio-producing componentry to frequency measurement componentry during calibration mode.

Different types of calibration mode may be present in various embodiments. The process flow of FIG. 1 may be repeated as part of a calibration mode that runs, for example, continuously or sequentially through more than one musical note. In some instances, for example, the note identifier may be received as part of an "initial" calibration mode, in which each musical note is adjusted in accordance with coarse or fined grained parameters. In some cases, the note identifier may be received as one of many note identifiers forming a "power-up" or "startup" cycle in which coarsely-set control values may be more finely tuned to current environmental conditions. Sometimes, a note calibration request is part of a continuous calibration cycle, in which an analog audio synthesizer is "on" but not being actively played; a continuous calibration cycle may calibrate based on some factor, e.g., selecting for adjustment the most frequently played notes, the most commonly played notes, the notes that were calibrated the least recently, or some combination of these factors. In some embodiments, not all notes are calibrated, and, for example, the control values of intermediate notes are interpolated from surrounding, calibrated values.

A control value associated with the note identifier is retrieved (S30); in some embodiments, the control value may be obtained by the frequency calibrator 200 from a control values store 210. The control values store maps the note identifier into a control value associated with a component in the analog audio synthesizer's audio signal generation chain.

For example, the control value can instruct a Digital to Analog Converter (DAC) to produce an analog signal. The DAC converts the control value, often an abstract finite-precision number, such as a fixed-point binary number, into a physical analog signal. The analog signal may be, e.g., current, voltage, charge, and pressure, though in an analog audio synthesizer the analog signal is often expressed as a control voltage. The analog signal directs a VCO to produce a wave of a particular frequency.

The control value retrieved from the control values store by the frequency calibrator during a calibration mode is the same numerical value that would be retrieved and sent by the note player to a DAC during a playing mode.

A control values store may be structured in a multiplicity of ways, the simplest example of which is a table with one column for a note identifier and one column for an associated control value; each row represents a mapping of these values for a single musical note.

In some embodiments, control values for musical notes may be stored in dynamic storage. The dynamic storage may be, for example, random access memory (RAM) that may be cleared when the audio synthesizer is turned off or unplugged. When the analog audio synthesizer performs a startup calibration or continuous calibration mode, for example, the calibrated control values might be stored temporarily in RAM because the calibrated values pertain specifically to the particular environmental conditions of that operational cycle.

In some cases, the control values may be stored in persistent storage, e.g., flash memory, an HDD, or SDD. The persistent storage is rewriteable and is capable of retaining data even when the audio synthesizer is turned off or unplugged. A persistent storage can be used, for example, during an initial calibration mode performed at the factory. For instance, coarsely calibrated control values may be saved to the persistent storage and serve as starting values for startup calibration or continuous calibration modes. In some embodiments, the control values store might be saved from dynamic storage to persistent storage periodically during operation of the synthesizer or during power-down of the synthesizer.

The control value is sent to one or more wave-generating components (e.g., 215 of FIG. 2) that generate an electrical output wave of a target frequency and waveform (S40). Some of the wave-generating components are part of the audio signal generation chain of the synthesizer. As noted, in some embodiments the one or more wave-generating components may be, for example, one or more DACs and/or one or more VCOs. In at least some analog audio synthesizers, a DAC converts the control value to a control voltage which is used to direct the oscillation frequency of a VCO. A multiplicity of DACs and a multiplicity of VCOs may exist in some embodiments, depending on the implementation provided for the analog audio synthesizer.

The audio signal chain generally starts with one or more VCOs generating a selection of different waveforms of frequency indicated by the instruction (e.g., a control voltage) issued by the DAC. In most cases, the VCO's output waves include at least saw tooth waves and square waves.

As noted (with respect to S20), when the frequency calibrator is in its calibration mode, the output volume level of audio-producing componentry (e.g., a VCA) is set to zero so that sound will not play during calibration. At least one of the output waves from the wave-generating componentry is sent to the frequency calibrator for measurement and analysis. In some embodiments, one or more output waves may be sent to a component that is physically or logically distinct from the frequency calibrator; this "frequency counter" component may be a dedicated hardware unit or device that receives an analog wave of a particular waveform and determines its characteristics.

The output wave is received from the wave-generating components 215 and measured to determine its measured frequency (fm) (S50). The output wave may preferably be a square waveform in some embodiments. In some embodiments, the output wave is analyzed and measured by counting, over a particular time interval, the number of completed cycles and measuring the performed portion of the non-completed cycles. Embodiments using a frequency counter component can send the measured frequency of the output wave to the frequency calibrator.

The reference frequency (fc) of the electrical output wave for the note identifier under ideal conditions is determined (S60). The reference frequency is determined in some embodiments by retrieving the reference frequency from a frequency values store (e.g., 220 of FIG. 2) or other data store associated with the frequency calibrator. The frequency values store may be, for example, a two-column table of lookup values storing the reference frequency value associated with each note identifier. The frequency values store may reside in the firmware of a microcontroller in some embodiments. In other embodiments, the reference frequency can be calculated dynamically by the frequency calibrator.

The measured frequency and the reference frequency are compared to determine whether the wave-generating componentry (e.g., the DCA and/or VCO) is properly calibrated for the current conditions (S70). The accuracy of the calibration is determined with respect to a tolerance value (e).

The tolerance value indicates the acceptable amount by which a given measured frequency can vary from its reference frequency.

In some cases, the tolerance value will be set by the manufacturer of the analog audio synthesizer based on various factors. In some cases, the tolerance value may be user-adjustable. Sometimes, the size of the tolerance value is constrained by the quality/resolution of the VCO and/or other system components. In some embodiments, a specific tolerance value may be associated with each VCO of a multiplicity of VCOs. In some embodiments, a specific tolerance value may be associated with each reference frequency.

When the measured frequency is within the tolerance value (e) of the reference frequency, the calibration request for that particular note identifier is completed and calibration mode as to that calibration request is terminated (S75). Processing control may be returned to the sender of the note calibration request.

Generally described, if the measured frequency is not within the tolerance value, the control value is adjusted and updated in the control values store with a modified control value, and the calibration cycle (e.g., starting again at S30) repeats for that note identifier. If the measured frequency is less than the reference frequency minus the tolerance value ($fm<fc-e$), then the control value is raised by some increment to create a modified control value that replaces the current control value stored in the control values store (S71). If the measured frequency is greater than the reference frequency plus the tolerance value ($fm>fc+e$), then the control value is lowered by some decrement to create a modified control value that replaces the current control value stored in the control values store (S72).

The increment or decrement by which the control value is adjusted may be determined in a variety of ways according to embodiment. In certain embodiments, the increment/decrement may be a scalar quantity representing a measurable fraction of the control value. For example, if the control value is denoted as a floating point value measurable to eight decimal points, the increment/decrement could be 0.00000001. In some instances, the increment/decrement may be a percentage or factor of the control value, e.g., 1% of the control value. In some implementations, the increment/decrement may be a percentage or factor of the absolute value of the difference between the measured frequency and the reference frequency; for example, if the difference between fm and fc is x, then the increment/decrement may be 10% of x, normalized to the control value. In some embodiments, the increment/decrement is a factor or percentage of the tolerance value (e), such as 10% of e. In some implementations, a binary search method can be applied to determine an adequate increment/decrement for the control value adjustment.

In some cases, a specific increment/decrement (whether a scalar value, percentage, or factor) can be associated with each note identifier, or even with a specific type, brand, or quality of wave-generating componentry. Furthermore, in some embodiments, the magnitude of the scalar value or percentage can vary in accordance with the type of calibration mode; e.g., an initial/factory calibration mode proving coarse calibration may attempt to calibrate quickly in accordance with a coarser calibration target by using larger increments/decrements with each adjustment. Naturally, the magnitude of the increment and the decrement can be an identical value, percentage, or factor.

After the control value is incremented or decremented to create the modified control value, the modified control value is used to update the control value in the control values store. Processing for the calibration request then continues by repeating the processing from step S30. Advantageously, this behavior allows the control value to gradually improve in accuracy even if the calibration mode were to be interrupted—for example, if a continuous calibration mode were interrupted by a user playing a note on the synthesizer.

Certain embodiments of techniques and systems of the subject invention may be appropriate for types of calibration mode in which multiple musical notes are calibrated in a set or as a series. A calibration mode for calibrating multiple musical notes repeats the calibration cycle for each note identifier in the set and terminates the calibration mode when there are no more note identifiers remaining in the set.

In such embodiments, the multiple musical notes are part of an ordered set of note identifiers that are calibrated in accordance with some ordering principle. Both the contents of the ordered set and the principle by which members of the set are ordered may be determined by the type of calibration mode. The ordering principle may be used to establish the priority of the control values being calibrated so that, in modes where the calibration process may be interrupted, the most relevant control values are calibrated first.

The members of the ordered set can include every note identifier used by the synthesizer. In some instances, the members of the ordered set include only a subset of the note identifiers, for example the note identifiers for one musical note per octave. In cases where the calibration mode includes only a subset of note identifiers, control values for intermediate values may be interpolated from the surrounding calibrated values using standard techniques.

The ordering criteria for arranging the ordered set can be one or more of several criteria. In some embodiments, when the control value in the control values store is updated, the "last calibration time" associated with the note identifier is also updated. The last calibration time may be stored in the control values store, for example in an additional column in the control values store, or in a separate data store. In such embodiments, the ordering of the ordered set can be determined in accord with the last calibration time, for example, from least-to-most recent last calibration time.

The ordering criteria for arranging the ordered set can, in certain instances, relate to additional factors, e.g., selecting for adjustment the most frequently played notes on the particular audio synthesizer, the most commonly played notes on the audio synthesizer or in general musical parlance, and/or the highest to lowest (or lowest to highest) frequency of the musical notes. Naturally, some combination of these factors, including the last calibration time, may also constitute composite ordering criteria.

The calibration mode may determine aspects of the calibration activity, including the contents and ordering criteria of the ordered set. In an embodiment with an "initial" or "factory" calibration mode, each musical note is adjusted in accordance with settings that may range from normal to coarse. The initial calibration mode might be initiated, for example, by a technician at the manufacturing facility, by a new buyer when the synthesizer is first powered on, or in response to a hardware reset switch on the synthesizer.

As an example, in an initial calibration mode, the control values for every musical note generated by the synthesizer might be calibrated; thus, the contents of the ordered set might be every note identifier used by the synthesizer ordered from highest to lowest frequency. The tolerance value (e) might be larger for the initial calibration mode than for other modes, indicating a "coarse" calibration.

In some embodiments, the type of calibration mode may be a "power-up" (or "startup") mode in which existing may be more finely tuned to current environmental conditions. A power-up calibration mode may begin when a synthesizer is turned on after having been "off" for some amount of time. The power-up calibration mode initiates because the componentry of the synthesizer, e.g., the VCO, benefits from calibration on the basis of current environmental conditions. It is well known that a VCO can require a different control voltage to make an analog wave of a particular frequency under different environmental conditions such as temperature, pressure, and humidity.

In a power-up calibration mode, the frequency calibrator may, for example, fine-tune the coarsely-set control values from the initial calibration mode. As an example, the ordered set for the power-up calibration mode might contain all the note identifiers the synthesizer is capable of producing. The ordered set might be ordered in accordance with the most frequently used notes on the particular synthesizer.

Some embodiments may have a "continuous" calibration mode, wherein the frequency calibrator performs its calibration operations when the analog audio synthesizer is "on" but not being actively played for a certain idle time period, such as five minutes. When an idle time period has been entered, the continuous calibration mode fine-tunes the control values to current environmental conditions; this mode is advantageous because the control values may benefit from adjustment over the course of an evening of playing (e.g., as the components warm up or as a club warms up from becoming more crowded). For example, the continuous calibration mode might cyclically iterate through a set of all the note identifiers, ordered in accordance with the least-to-most recent last calibration time.

In certain embodiments, a calibration mode may be interrupted by a command to audibly play a musical note from a note player component. Such a command might be instigated by a musician's press of a key on the synthesizer keyboard. Any calibration mode, but particularly a continuous calibration mode, may react to a command to play a musical note by terminating the calibration mode. Termination of the calibration mode may at least include returning control of audio-producing componentry (e.g., a VCA) to a normal operational state of the audio synthesizer with the usual note-playing logic, e.g., by no longer enforcing a zero output volume level.

At the termination of any calibration mode, an updated control value, or the control values store in its entirety, may be duplicated or copied from a dynamic memory area (e.g., RAM) to a persistent memory area (e.g., flash memory or HDD). In some embodiments, the control values store may be copied from dynamic memory to persistent memory when the synthesizer is turned off. In further embodiments, when a synthesizer is turned on again subsequently, the control values store stored in the persistent memory area is used to initialize the dynamic memory area with the starting set of control values.

Figure 3:
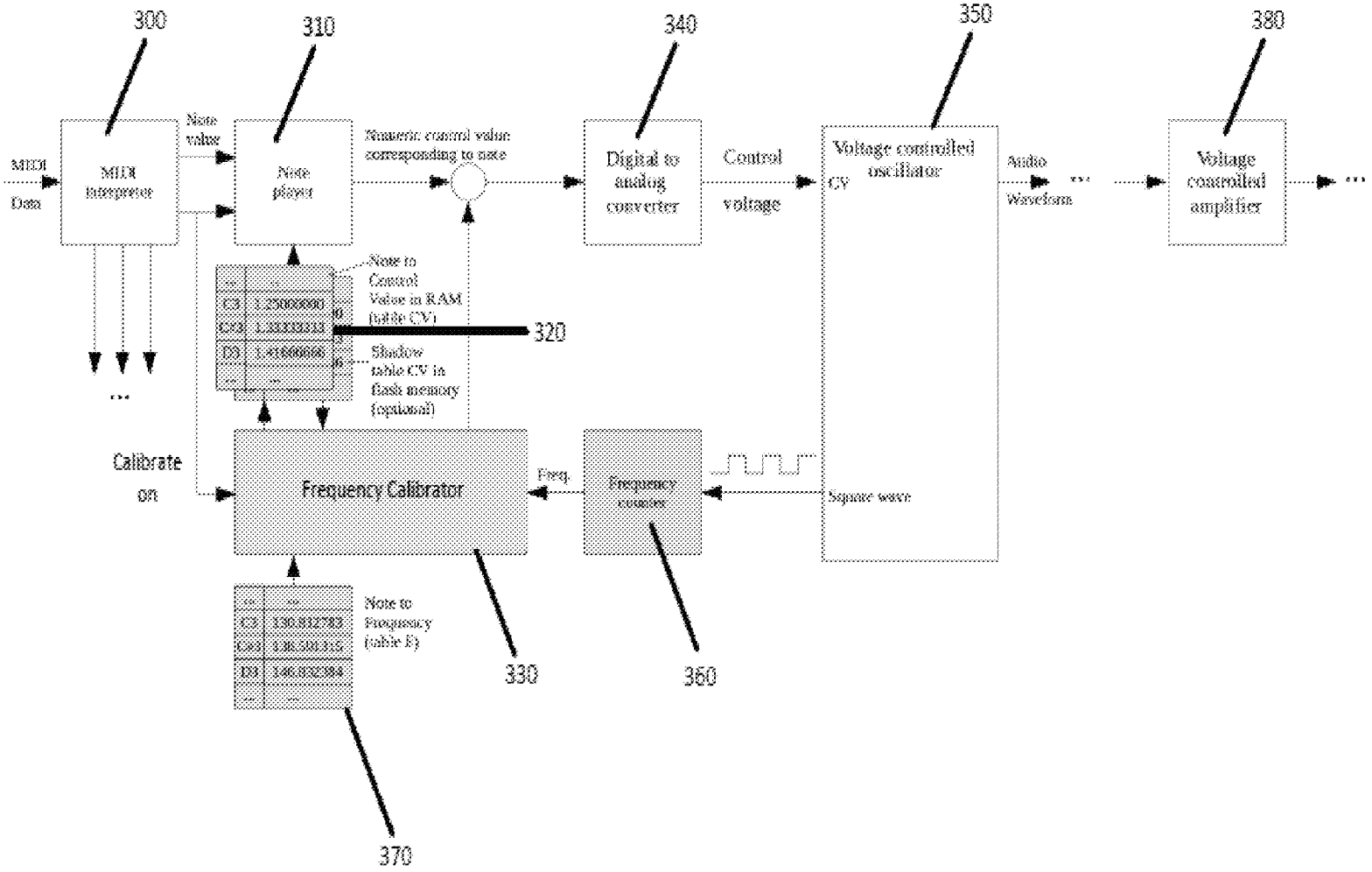
FIG. 3 shows a block diagram of components in a specific example implementation environment.

FIG. 3 shows a block diagram of components in a specific example implementation environment. The lighter blocks (e.g., 300, 310, 340, 350, and 380) show components likely present in an existing implementation environment such as an analog audio synthesizer. The darker blocks (320, 330, 360, and 370) show components implementing techniques and systems of the subject invention.

In FIG. 3, in a normal playing mode, MIDI data is received by a MIDI interpreter 300 that translates commands from a keyboard or Digital Audio Workstation (DAW), which usually follow the MIDI protocol, to internal commands for the synthesizer's components. The commands are received by a "note player" 310 that transforms the command to play a certain note (e.g., a "note identifier") to the control value to send to a Digital to Analog Converter 340 (often there is more than one DAC—one for each oscillator). In a traditional analog audio synthesizer environment, the note player 310 can perform the transformation of the note identifier into the control value for directing the DACs 340. Depending on the synthesizer implementation, this transformation is performed through, e.g., lookup tables, computation, or even specialized hardware.

In the example embodiment of FIG. 3, the note player 310 instead obtains the value from the control values store 320. As illustrated in FIG. 3, the control values store 320 may be implemented as a table in RAM, but may also be copied to flash memory to a shadow control values store to persist the calibrated values.

After obtaining the control value, the note player 310 sends the control value to the DAC 340, which creates an analog control voltage and sends it to at least one VCO 350. The VCO 350 creates an audio waveform and sends it to other audio-producing components, such as a VCA 380, to amplify and produce the audible sounds from the waveform.

A calibration mode is also illustrated by FIG. 3. The frequency calibrator 330 can receive, e.g., a calibration command ("calibrate on"), or may enter a continuous calibration mode via an idle timer, as described. In a calibration mode, the frequency calibrator assumes control of the VCA 380 and sets its output volume to zero so that no audible sounds are generated while calibrating. In a calibration mode in FIG. 3, the frequency calibrator 330 retrieves the control value from the control values store 320 for the next note identifier and sends the control value to the DAC 340, which creates an analog control voltage. The DAC 340 sends the control voltage to at least one VCO 350. The output wave from the VCO 350 is also directed back to the frequency calibrator 330, in this example through a frequency counter component 360. The frequency of the output wave from the VCO is measured and the "reference frequency" for that note identifier is obtained, in this example from a frequency values store 370. The frequency calibrator 330 compares the measured frequency and the reference frequency and adjusts the control value accordingly, if necessary. If adjustment is not necessary, the frequency calibrator 330 moves to the next note identifier or terminates the calibration mode. When the calibration mode is terminated, the frequency calibrator 330 releases control of the VCA 380 back to the note player 310 to resume performing the normal note-playing logic.

Example operational scenarios will be described, some of which make reference to components in FIG. 3. These scenarios may illustrate advantages, including technical effects, of the disclosed techniques and systems. These scenarios/examples should not be construed as limiting.

For this set of scenarios, assume a relatively simple audio synthesizer freshly assembled in the factory, with only one voltage controlled oscillator 350, followed by a voltage controlled filter and a voltage controlled amplifier 380. Without any note playing, the VCA's 380 output volume is set to zero.

The initial coarse calibration is one of the last steps taken on the manufacturer's premises. The synthesizer is switched on for the first time by an employee and the standard control voltage level values are copied into the RAM table CV (e.g., 320). Then, while keeping the amplifier's volume at zero, the frequency calibrator 330 starts its work: it iterates through all notes in the machine's range, starting at the lowest note and working upwards. By iteratively raising or lowering the applied values it determines the exact numerical value which has to be transmitted to the DAC 340 to result in the desired frequency. These values are copied to the flash memory shadow table CV in flash memory after completion. The machine is switched off, boxed, and transported to a dealer.

Six weeks later, a new owner unboxes the machine in her living room, which is substantially warmer than the factory premises. She switches it on and, while the owner reads the manual, the synthesizer executes the power-up calibration procedure, reading the coarse control values from the flash memory table and calibrating the oscillator according to the current environment conditions. The detected values are written to the flash memory shadow table CV. After a while the owner starts playing the machine and the synthesizer receives a first MIDI command from a keyboard. The frequency calibrator returns control to the MIDI player, the VCO's frequency is changed according to the desired note based on the values found in RAM table CV 320, and the VCA 380 begins to produce sound according to the synthesizer's parameters. The new owner is pleased with the machine, as it needs no tiresome manual calibration process like many others.

Later on, after an hour of operation, the synthesizer's components have sufficiently warmed up and the VCO's response to the control voltage has significantly drifted due to changing electrical characteristics of some of its components. Without compensation, this would result in frequency shifts and the need for manual re-calibration. However, since the continuous calibration mode is active in non-playing periods, the frequency drift is continuously compensated, resulting in a nearly constantly calibrated instrument.

Figure 4:
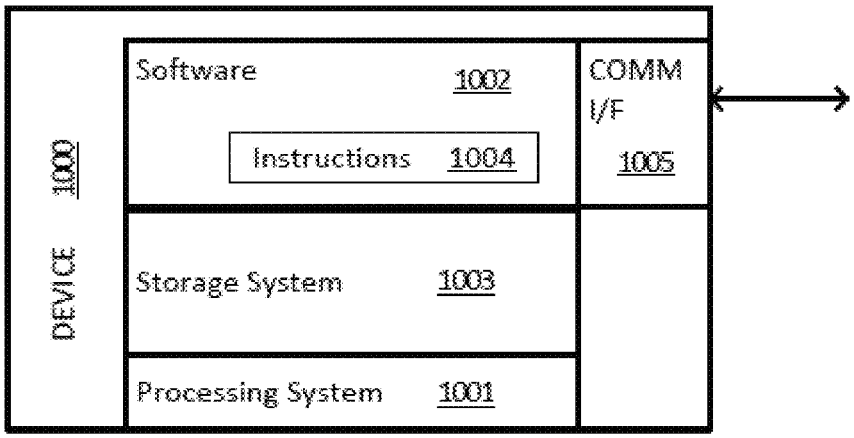
FIG. 4 shows a block diagram illustrating components of a computing device or system used in some implementations or embodiments incorporating techniques and systems for frequency calibration as described herein.

FIG. 4 shows a block diagram illustrating components of a computing device or system used in some implementations or embodiments incorporating techniques and systems for frequency calibration as described herein. For example, any component of the system, including a frequency calibrator, control values store, and frequency values store may be implemented as described with respect to device 1000, which can itself include one or more computing devices. The hardware can be configured according to any suitable computer architectures such as a Symmetric Multi-Processing (SMP) architecture or a Non-Uniform Memory Access (NUMA) architecture.

The device 1000 can include a processing system 1001, which may include a processing device such as a central processing unit (CPU) or microprocessor and other circuitry that retrieves and executes software 1002 from storage system 1003. Processing system 1001 may be implemented within a single processing device but may also be distributed across multiple processing devices or sub-systems that cooperate in executing program instructions.

Examples of processing system 1001 include general purpose central processing units, application specific processors, and logic devices, as well as any other type of processing device, combinations, or variations thereof. The one or more processing devices may include multiprocessors or multi-core processors and may operate according to one or more suitable instruction sets including, but not limited to, a Reduced Instruction Set Computing (RISC) instruction set, a Complex Instruction Set Computing (CISC) instruction set, or a combination thereof. In certain embodiments, one or more digital signal processors (DSPs) may be included as part of the computer hardware of the system in place of or in addition to a general purpose CPU.

Storage system 1003 may comprise any computer readable storage media readable by processing system 1001 and capable of storing software 1002 including, e.g., processing instructions for calibrating an analog audio synthesizer as described herein. Storage system 1003 may include volatile and nonvolatile, removable and non-removable media implemented in any method or technology for storage of information, such as computer readable instructions, data structures, program modules, or other data.

Examples of storage media include random access memory (RAM), read only memory (ROM), magnetic disks, optical disks, CDs, DVDs, flash memory, solid state memory, phase change memory, 3D-Xpoint memory, or any other suitable storage media. Certain implementations may involve either or both virtual memory and non-virtual memory. In no case do storage media consist of a propagated signal. In addition to storage media, in some implementations, storage system 1003 may also include communication media over which software 1002 may be communicated internally or externally.

Storage system 1003 may be implemented as a single storage device but may also be implemented across multiple storage devices or sub-systems co-located or distributed relative to each other. Storage system 1003 may include additional elements capable of communicating with processing system 1001.

Software 1002 may be implemented in program instructions and, among other functions, may, when executed by device 1000 in general or processing system 1001 in particular, direct device 1000 or processing system 1001 to operate as described herein for calibrating an analog audio synthesizer. Software 1002 may provide program instructions 1004 that implement components for frequency calibration. Software 1002 may implement on device 1000 components, programs, agents, or layers that implement in machine-readable processing instructions 1004 the methods and techniques described herein.

In general, software 1002 may, when loaded into processing system 1001 and executed, transform device 1000 overall from a general-purpose computing system into a special-purpose computing system customized to calibrate frequencies of an audio synthesizer in accordance with the techniques herein. Indeed, encoding software 1002 on storage system 1003 may transform the physical structure of storage system 1003. The specific transformation of the physical structure may depend on various factors in different implementations of this description. Examples of such factors may include, but are not limited to, the technology used to implement the storage media of storage system 1003 and whether the computer-storage media are characterized as primary or secondary storage. Software 1002 may also include firmware or some other form of machine-readable processing instructions executable by processing system 1001. Software 1002 may also include additional processes, programs, or components, such as operating system software and other application software.

Device 1000 may represent any computing system on which software 1002 may be staged and from where software 1002 may be distributed, transported, downloaded, or otherwise provided to yet another computing system for deployment and execution, or yet additional distribution.

A communication interface 1005 may be included, providing communication connections and devices that allow for communication between device 1000 and other computing systems (not shown) over a communication network or collection of networks (not shown) or the air. Examples of connections and devices that together allow for inter-system communication may include network interface cards, antennas, power amplifiers, RF circuitry, transceivers, and other communication circuitry. The connections and devices may communicate over communication media to exchange communications with other computing systems or networks of systems, such as metal, glass, air, or any other suitable communication media. The aforementioned communication media, network, connections, and devices are well known and need not be discussed at length here.

It should be noted that many elements of device 1000 may be included in a microcontroller or a system-on-a-chip (SoC) device. These elements may include, but are not limited to, the processing system 1001, a communications interface 1005, and even elements of the storage system 1003 and software 1002.

Alternatively, or in addition, the functionality, methods and processes described herein can be implemented, at least in part, by one or more hardware modules (or logic components). For example, the hardware modules can include, but are not limited to, application-specific integrated circuit (ASIC) chips, field programmable gate arrays (FPGAs), system-on-a-chip (SoC) systems, microcontrollers, complex programmable logic devices (CPLDs) and other programmable logic devices now known or later developed. When the hardware modules are activated, the hardware modules perform the functionality, methods and processes included within the hardware modules.

It should be understood that the examples and embodiments described herein are for illustrative purposes only and that various modifications or changes in light thereof will be suggested to persons skilled in the art and are to be included within the spirit and purview of this application.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

What is claimed is:

1. A system for calibrating an analog audio synthesizer, the system comprising:

one or more computer readable storage media;

a processing system;

program instructions for a frequency calibrator component stored on at least one of the one or more computer readable storage media that, when executed by the processing system, direct the processing system, in response to entering a calibration mode that defines an ordered set of one or more note identifiers of musical notes to calibrate, to:

(A) set an output volume level of audio-producing componentry to zero;

(B) select a current note identifier in the ordered set of one or more note identifiers, wherein the current note identifier is a next note identifier in the ordered set, wherein the calibration mode terminates when there is no next note identifier in the ordered set;

(C) retrieve, from a control values store on at least one of the one or more computer readable media, a control value associated with the current note identifier, wherein the control value indicates a translation factor for instructing a digital to analog converter (DAC) to generate an analog control voltage;

(D) send the control value to the DAC, wherein the DAC generates the analog control voltage and sends the analog control voltage to a voltage controlled oscillator (VCO), wherein the analog control voltage instructs the VCO to generate an electrical output wave of a target frequency and waveform;

(E) receive the electrical output wave from the VCO;

(F) measure a measured frequency (fm) of the electrical output wave;

(G) determine a reference frequency (fc) of the electrical output wave for the current note identifier;

(H) compare the measured frequency and the reference frequency with respect to a tolerance value (e) and, (H1) when $fc+e \geq fm \geq fc-e$, return to step (B) for the next note identifier in the ordered set, and (H2) when $fm < fc-e$, raise by an increment the control value to create a modified control value, or when $fm > fc+e$, lower by a decrement the control value to create the modified control value, update the control value in the control values store with the modified control value, and return to step (C).

2. The system of claim 1, wherein the ordered set for the calibration mode comprises note identifiers for every musical note generated by the analog audio synthesizer.

3. The system of claim 1, wherein the ordered set for the calibration mode comprises note identifiers for one musical note for per octave.

4. The system of claim 1, wherein the calibration mode is a continuous calibration mode that is entered when the analog audio synthesizer is "on" but is not being used by a user for an idle time period, wherein the next note identifier is the least recently calibrated note identifier in the control value store.

5. The system of claim 1, further comprising program instructions stored on the one or more computer readable storage media that, when executed by the processing system, direct the processing system to:

in response to receiving, from a note player component of the analog audio synthesizer, a request descriptive of a command to play a particular musical note:

terminate an active calibration mode;

retrieve, from the control values store, the control value for the note identifier of the particular musical note; and send the control value to the DAC.

6. The system of claim 1, wherein updating the control value in the control value store further comprises updating a last calibration time associated with the current note identifier.

7. The system of claim 6, wherein the ordering of the one or more note identifiers in the ordered set is from least-to-most-recent last calibration time of the one or more note identifiers.

8. The system of claim 1, wherein the one or more note identifiers in the ordered set are ordered according to one or more of the following ordering criteria:

highest to lowest frequency of the musical note;

commonness of use of the one or more note identifiers; and frequency of use of the one or more note identifiers on a given analog audio synthesizer.

9. The system of claim 1, wherein the magnitude of the increment and the decrement is determined at least partially by the calibration mode.

10. The system of claim 1, wherein the tolerance value (e) associated with the calibration mode is retrieved from at least one of the one or more computer readable storage media.

11. The system of claim 1, wherein the audio-producing componentry comprises a voltage controlled amplifier (VCA).

12. The system of claim 1, wherein the determining of the reference frequency comprises retrieving, from a frequency values store on the one or more computer readable media, a reference frequency value associated with the current note identifier.

13. The system of claim 1, wherein the control values store is copied from dynamic memory to persistent flash memory at the termination of the calibration mode.

14. The system of claim 1, further comprising program instructions stored on the one or more computer readable storage media that, when executed by the processing system, direct the processing system to:

interpolate control values for a second set of note identifiers, wherein the second set of note identifiers comprises note identifiers not in the ordered set, from control values for note identifiers in the ordered set.

15. A method for calibrating an oscillation frequency for a musical note in an analog audio synthesizer, the method comprising:

(A) receiving a note identifier of the musical note to calibrate;

(B) entering a calibration mode, wherein the calibration mode sets an output volume level of audio-producing componentry to zero;

(C) retrieving, from a control values store, a control value associated with the note identifier;

(D) sending the control value to wave-generating componentry, wherein the wave-generating componentry generates an output wave of a target frequency and waveform;

(E) receiving the output wave from the wave-generating componentry and measuring a measured frequency (fm) of the output wave;

(F) determining a reference frequency (fc) of the output wave for the current note identifier;

(G) comparing the measured frequency (fm) and the reference frequency (fc) with respect to a tolerance value (e) and, (G1) when $fm<fc-e$, raising by an increment the control value to create a modified control value, or when $fm>fc+e$, lowering by a decrement the control value to create the modified control value, updating the control value in the control values store with the modified control value, and returning to step (C), and (G2) when $fc+e\geq fm\geq fc-e$, terminating the calibration mode.

16. The method of claim 15, wherein the increment and decrement are determined according to one of the following:

a scalar quantity representing a measurable portion of the control value;

a percentage of the control value;

a binary search;

a percentage of the difference between the measured frequency and the reference frequency; and a percentage of the tolerance value.

17. The method of claim 15, wherein the magnitude of the increment and the decrement is determined at least partially by the wave-generating componentry.

18. The method of claim 15, wherein the increment and decrement are determined in reference to the note identifier.

* * * * *